US008953002B2

(12) United States Patent
Kodo

(10) Patent No.: US 8,953,002 B2
(45) Date of Patent: Feb. 10, 2015

(54) IMAGE FORMING APPARATUS

(71) Applicant: Masahiro Kodo, Shizuoka (JP)

(72) Inventor: Masahiro Kodo, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 65 days.

(21) Appl. No.: 13/652,024

(22) Filed: Oct. 15, 2012

(65) Prior Publication Data

US 2013/0100225 A1 Apr. 25, 2013

Related U.S. Application Data

(60) Provisional application No. 61/548,022, filed on Oct. 17, 2011.

(51) Int. Cl.

| | |
|---|---|
| ***B41J 2/385*** | (2006.01) |
| ***B41J 2/41*** | (2006.01) |
| ***B41J 2/45*** | (2006.01) |
| ***B41J 2/435*** | (2006.01) |
| ***G03G 15/00*** | (2006.01) |
| ***G03G 15/04*** | (2006.01) |
| ***G03G 21/16*** | (2006.01) |

(52) U.S. Cl.

CPC ..... *G03G 15/00* (2013.01); *G03G 15/04054* (2013.01); *G03G 21/1647* (2013.01); *G03G 21/1666* (2013.01); *G03G 21/1676* (2013.01)

USPC ..... 347/138; 347/130; 347/152; 347/238; 347/245; 347/263

(58) Field of Classification Search

USPC ..... 347/130, 138, 152, 238, 245, 263

See application file for complete search history.

(56) References Cited

U.S. PATENT DOCUMENTS

| | | | | |
|---|---|---|---|---|
| 2003/0222968 | A1* | 12/2003 | Nagamine | 347/245 |
| 2007/0126852 | A1* | 6/2007 | Fukutome et al. | 347/262 |
| 2011/0222903 | A1 | 9/2011 | Kishi | |

* cited by examiner

*Primary Examiner* — Justin Seo
*Assistant Examiner* — Kendrick Liu
(74) *Attorney, Agent, or Firm* — Patterson & Sheridan LLP

(57) ABSTRACT

According to one embodiment, an image forming apparatus includes a photoconductive drum, a line-type LED exposing unit disposed to be opposed to the photoconductive drum, an exposing unit supporting tray configured to support the LED exposing unit to be capable of approaching and separating from the photoconductive drum in a radial direction of the photoconductive drum, an extending piece being formed in a part of an end of the exposing unit supporting tray, and a rod member disposed in parallel to the major axis direction of the LED exposing unit and moved in the major axis direction to thereby cause the LED exposing unit to approach and separate from the photoconductive drum in the radial direction of the photoconductive drum via the extending piece of the exposing unit supporting tray.

9 Claims, 12 Drawing Sheets

DURING SEPARATION (DURING MAINTENANCE)

DURING APPROACH (DURING OPERATION)

IMAGE FORMING APPARATUS

CROSS-REFERENCE TO RELATED APPLICATIONS

This application is based upon and claims the benefit of priority from: U.S. provisional applications 61/548,022 filed on Oct. 17, 2011, the entire contents of which are incorporated herein by reference.

FIELD

Embodiments described herein relate generally to an image forming apparatus.

BACKGROUND

In an image forming apparatus such as a copying machine, a printer, or a compound machine (a multi-functional peripheral (MFP)) employing an electrophotographic system, an exposing device is used in order to form an electrostatic latent image on a photoconductive drum. If a line-type LED exposing unit including LEDs as light-emitting devices is used as the exposing device, it is possible to reduce the height of the image forming apparatus and provide a compact apparatus.

When the photoconductive drum (or a photoconductive unit in which the photoconductive drum is housed) is detached during maintenance or the like, the line-type LED exposing unit needs to be once separated from the photoconductive drum before the photoconductive drum is detached. Further, if the lens surface of the line-type LED exposing unit is cleaned, the line-type LED exposing unit needs to be separated from the photoconductive drum.

Meanwhile, a gap between a magnet roller incorporated in a developing unit and the photoconductive drum needs to be set to a predetermined short distance. Therefore, if the developing unit is detached during maintenance or the like, the developing unit needs to be once separated from the photoconductive drum before the developing unit is detached.

As a method of bringing the line-type LED exposing unit and the developing unit close to the photoconductive drum during operation, a method of pressing the line-type LED exposing unit and the developing unit in a direction toward the photoconductive drum via a spacer using a pressing force by an elastic member such as a spring is conceivable. However, in this method, a relatively large force (separation force) equal to or larger than the pressing force of the spring or the like needs to be applied if the line-type LED exposing unit and the developing unit are separated from the photoconductive drum. If a separating mechanism having structure resistible against the separation force is configured, the rigidity of components of the separating mechanism needs to be increased and the number of components of the separating mechanism increases. Further, the costs of the separating mechanism increase.

DETAILED DESCRIPTION

An image forming apparatus is explained with reference to the accompanying drawings.

In general, according to one embodiment, an image forming apparatus includes: a photoconductive drum; a line-type LED exposing unit disposed to be opposed to the photoconductive drum; an exposing unit supporting tray configured to support the LED exposing unit to be capable of approaching and separating from the photoconductive drum in the radial direction of the photoconductive drum, an extending piece being formed in a part of an end of the exposing unit supporting tray; and a rod member disposed in parallel to the major axis direction of the LED exposing unit, the rod member being moved in the major axis direction to cause the LED exposing unit to approach and separate from the photoconductive drum in the radial direction of the photoconductive drum via the extending piece of the exposing unit supporting tray.

(1) Image Forming Apparatus

Figure 1:
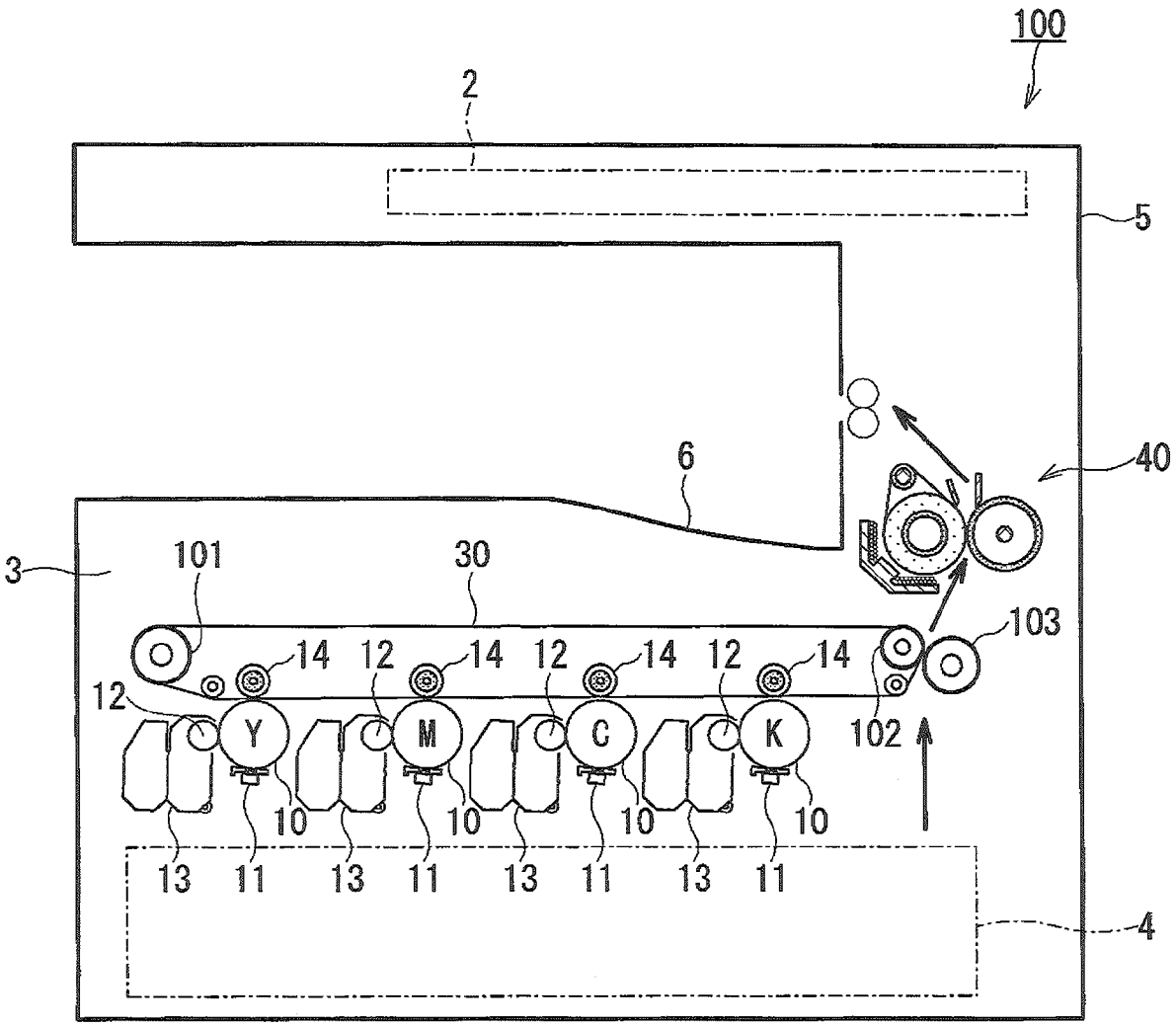
FIG. 1 is a sectional view showing an example of an internal configuration of an image forming apparatus according to an embodiment.

FIG. 1 is a schematic sectional view showing the configuration of a compound machine (or a multi-function peripheral (MFP)), which is a typical example of an image forming apparatus 100 according to this embodiment.

The image forming apparatus 100 includes an image reading device 2, an image forming section 3, a paper feeding section 4, and a housing 5 that houses the foregoing.

The image reading device 2 optically reads an original document placed on a document table and generates image data. The image forming section 3 prints the image data on a sheet fed from the paper feeding section 4 using an electrophotographic system. The printed sheet is discharged to and stacked on a paper discharge tray 6 of the housing 5.

The image forming section 3 is configured to be capable of performing color printing with, for example, a tandem type electrophotographic system. As shown in FIG. 1, four photoconductive drums 10 corresponding to four colors of yellow (Y), magenta (M), cyan (C), and black (K) are disposed along a conveying direction of a transfer belt 30. Line-type LED exposing units 11, developing units 13 incorporating magnet rollers 12, transfer rollers 14, and the like are disposed around the photoconductive drums 10.

The surfaces of the photoconductive drums 10 are uniformly charged to predetermined potential by a not-shown charging device. Thereafter, LED lights based on image data of the respective colors of Y, M, C, and K are irradiated on the surfaces of the photoconductive drums 10 for the respective colors from the line-type LED exposing units 11. When the LED lights are irradiated, the potential of portions where the LED lights are irradiated drops, and electrostatic latent images are formed on the surfaces of the photoconductive drums 10.

The developing units 13 store toners of colors corresponding thereto among the four colors of yellow (Y), magenta (M), cyan (C), and black (K). The toners are deposited on the surfaces of the photoconductive drums 10 by the magnet rollers 12 to develop the electrostatic latent images formed on the surfaces of the respective photoconductive drums 10. Toner images of the respective colors of Y, M, C, and K are respectively formed on the photoconductive drums 10.

The transfer belt 30 is looped around a driving roller 101 and a secondary transfer opposed roller 102. The transfer belt 30 continuously rotates according to the driving by the driving roller 101. While the transfer belt 30 passes through nips formed by the photoconductive drums 10 and the transfer rollers 14, the toner images of the respective colors of Y, M, C, and K are sequentially transferred onto the outer circumferential surface of the transfer belt 30. Finally, a full-color toner image is formed on the transfer belt 30. The full-color toner image reaches a nip (a secondary transfer position) formed by a secondary transfer roller 103 and the secondary transfer opposed roller 102 according to the movement of the transfer belt 30.

Meanwhile, a sheet is picked up from a paper feeding cassette incorporated in the paper feeding section 4 and conveyed to the secondary transfer position. In the secondary transfer position, the full-color toner image on the transfer belt 30 is transferred onto the sheet. Then, the full-color toner image is heated and pressurized and fixed on the sheet by a fixing device 40. Thereafter, the sheet is discharged to the paper discharge tray 6.

When monochrome printing is performed, a K toner image is transferred onto the transfer belt 30 by only the photoconductive drum 10 for K and the transfer roller 14 opposed to the photoconductive drum 10. The photoconductive drums 10 for Y, M, and C are not used.

(2) Separation and Approach Unit

Figure 2B:
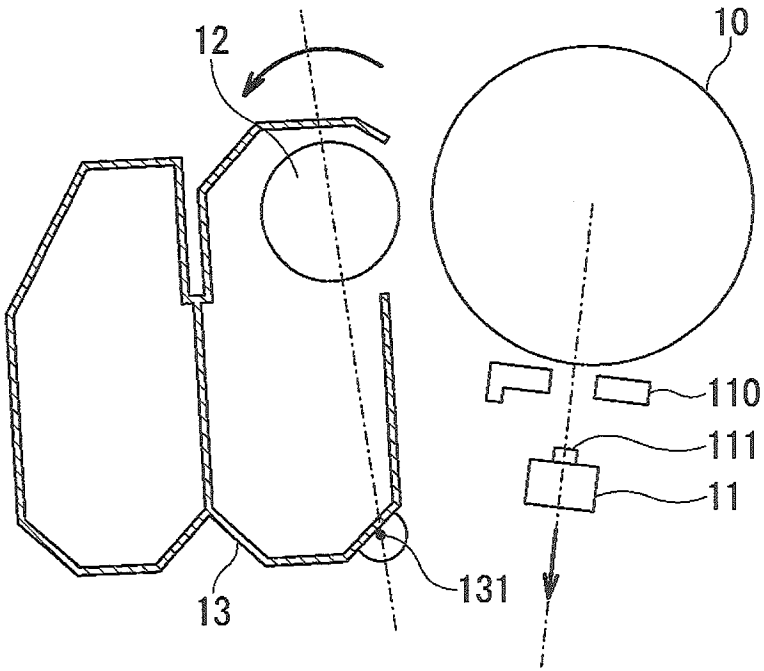
FIGS. 2A and 2B are sectional views respectively showing positional relations among a line-type LED exposing unit, a developing unit, and a photoconductive drum during approach and during separation.
Figure 2A:
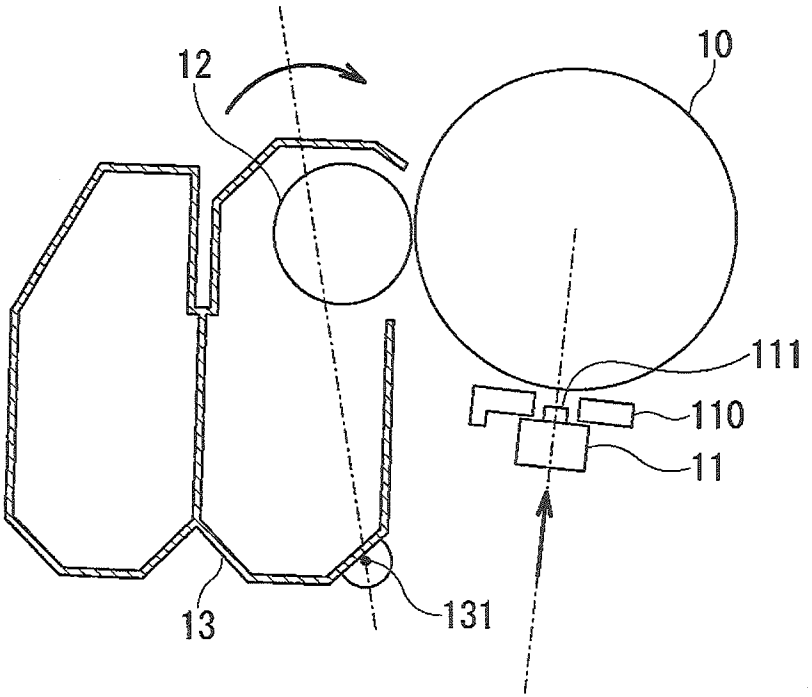

FIG. 2A is a schematic diagram showing a positional relation among the photoconductive drum 10, the line-type LED exposing unit 11, and the developing unit 13 during the operation of the image forming apparatus 100 according to this embodiment. Since the focal distance of the line-type LED exposing unit 11 is short as explained above, during the operation, the line-type LED exposing unit 11 is caused to approach the photoconductive drum 10 via a spacer 110. Similarly, the magnet roller 12 of the developing unit 13 is also caused to approach the photoconductive drum 10 during the operation.

On the other hand, FIG. 2B is a schematic diagram showing a positional relation among the photoconductive drum 10, the line-type LED exposing unit 11, and the developing unit 13 during maintenance or the like of the image forming apparatus 100 according to this embodiment. When the photoconductive drum 10 is detached or when a lens unit 111 of the line-type LED exposing unit 11 is cleaned during the maintenance or the like, as shown in FIG. 2B, the line-type LED exposing unit 11 is translated in the radial direction of the photoconductive drum 10 and separated from the photoconductive drum 10.

If the developing unit 13 is detached during the maintenance or the like, as shown in FIG. 2B, the magnet roller 12 incorporated in the developing unit 13 and the photoconductive drum 10 are separated. A developing unit supporting section 131 that axially supports the developing unit 13 to be pivotable is provided under the developing unit 13. During the maintenance or the like, the developing unit 13 is rotated in the counterclockwise direction in FIG. 2B about the axis of the developing unit supporting section 131 to separate the magnet roller 12 of the developing unit 13 from the photoconductive drum 10. Conversely, during the operation, the developing unit 13 is rotated in the clockwise direction in FIG. 2A to cause the magnet roller 12 of the developing unit 13 to approach the photoconductive drum 10.

In the image forming apparatus 100 according to this embodiment, the approach and the separation of the line-type LED exposing unit 11 and the approach and the separation of the developing unit 13 are performed using a separation and approach unit 200 peculiar to the embodiment. The configuration and the action of the separation and approach unit 200 according to this embodiment are explained below.

Figure 3:
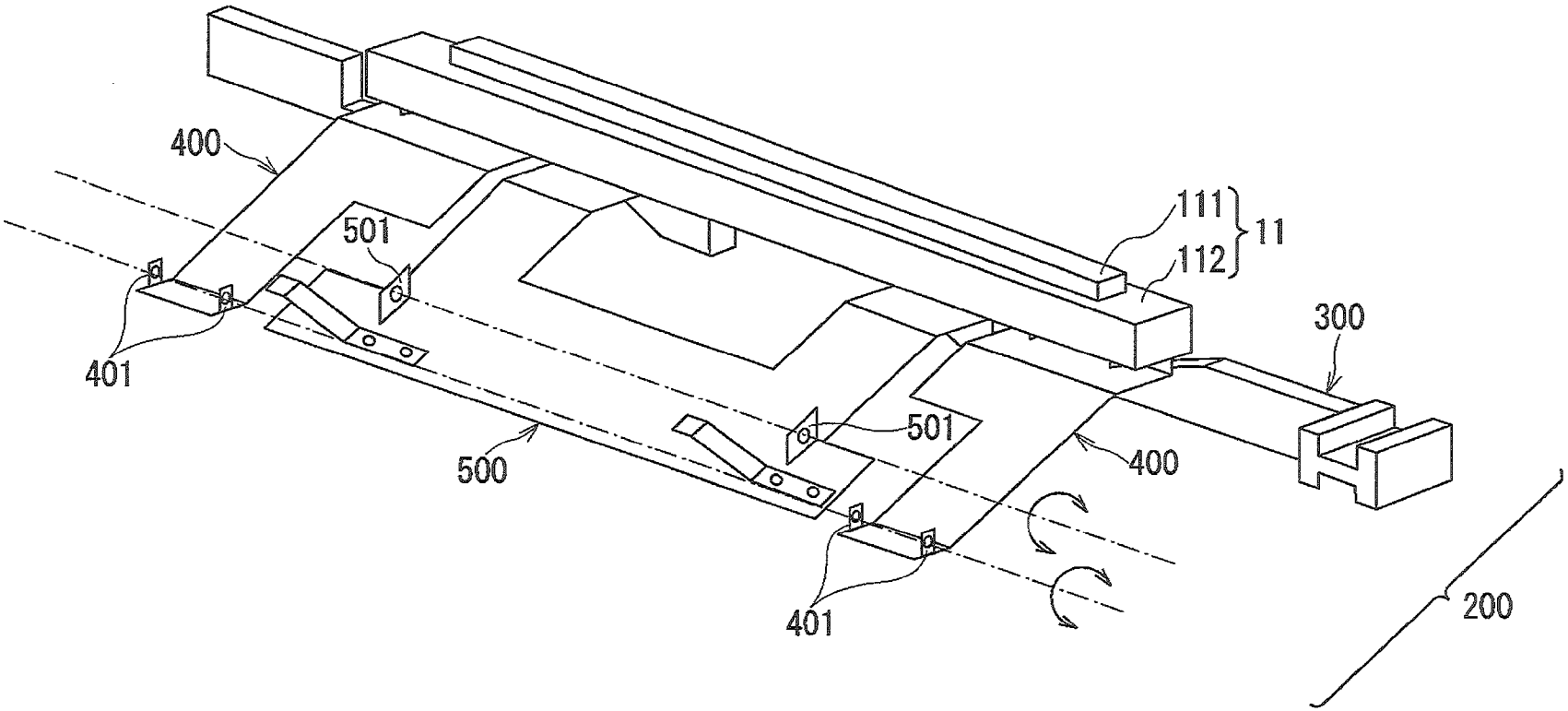
FIG. 3 is a perspective view showing a positional relation between a separation and approach unit and the line-type LED exposing unit.
Figure 4:
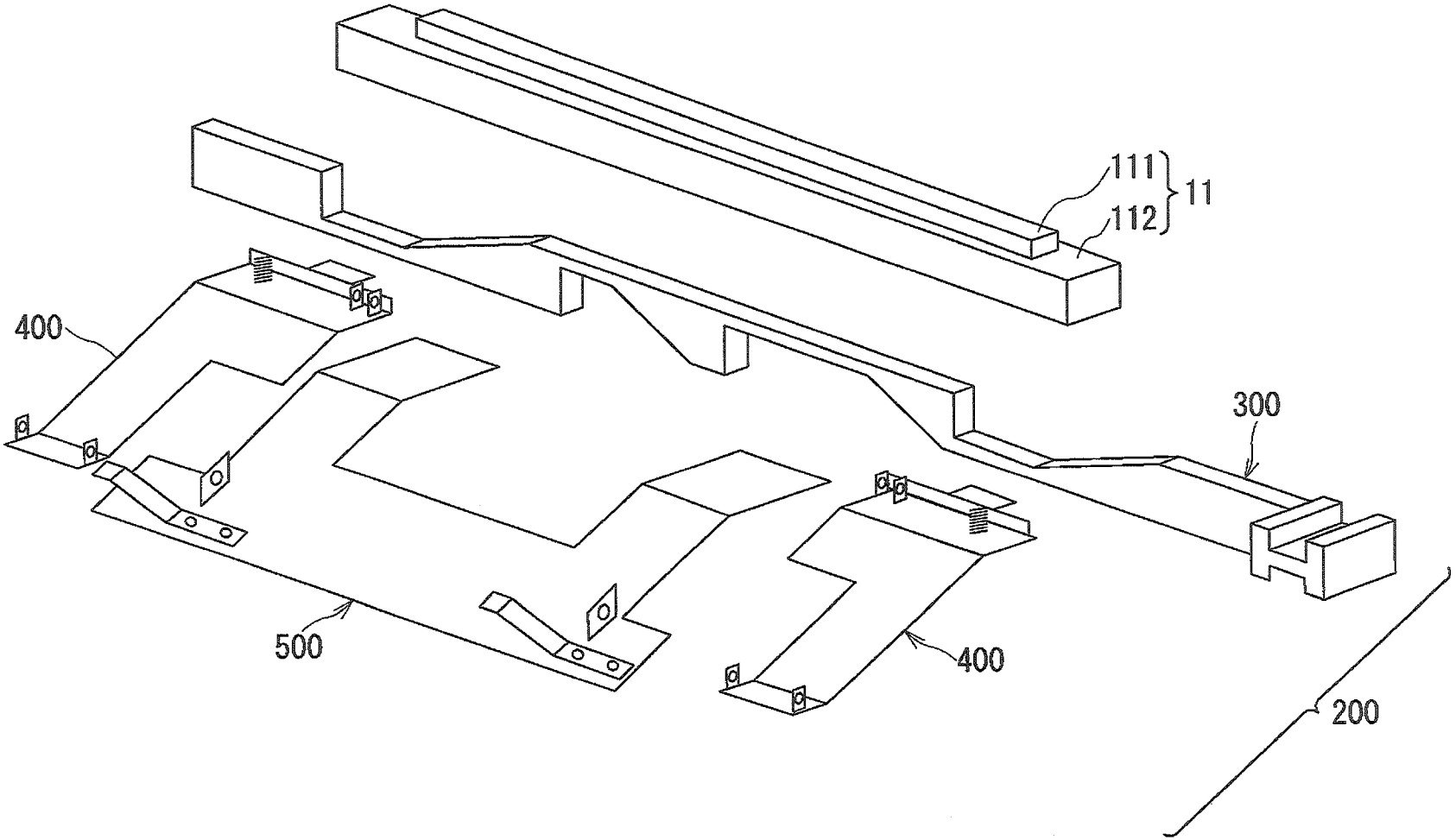
FIG. 4 is an exploded perspective view of the separation and approach unit and the line-type LED exposing unit.

FIG. 3 is a perspective view showing a positional relation between the separation and approach unit 200 and the line-type LED exposing unit 11. FIG. 4 is an exploded perspective view of the separation and approach unit 200 and the line-type LED exposing unit 11. Note that the separation and approach units 200 are provided one by one in each of the photoconductive drums 10 for the respective colors of Y, M, C, and K. However, since all the separation and approach units 200 have the same configuration, the separation and approach unit 200 is explained below without specifically distinguishing the colors.

The line-type LED exposing unit 11 includes a main body 112 that houses linearly-arrayed LEDs and the lens unit 111 that condenses LED lights on the surface of the photoconductive drum 10. The line-type LED exposing unit 11 is disposed to be opposed to the photoconductive drum 10 and in parallel to the rotation axis of the photoconductive drum 10. During the operation, a distance between the surface (a lens surface) of the lens unit 111 and the surface of the photoconductive drum 10 approaches to a distance of, e.g., 2 mm to 3 mm (equivalent to the focal length). On the other hand, during the maintenance or the like, in order to clean the lens surface or detach the photoconductive drum 10, a distance between the surface (the lens surface) of the lens unit 111 and the surface of the photoconductive drum 10 is separated to a distance of, for example, about 10 mm according to the action of the separation and approach unit 200.

The separation and approach unit 200 includes a rod member 300, an exposing unit supporting tray 400, and a developing unit supporting tray 500.

The exposing unit supporting tray 400 supports the line-type LED exposing unit 11 to be capable of approaching and separating from the photoconductive drum 10 in the radial direction of the photoconductive drum 10. Support bearings (first support bearings) 401 are provided at one end of the exposing unit supporting tray 400. The exposing unit supporting tray 400 is configured to be capable of pivoting about a supporting shaft (not shown in the figure) inserted into the support bearings 401.

The developing unit supporting tray 500 supports the developing unit 13 to be capable of causing the magnet roller 12 to approach the photoconductive drum 10 or separate from the photoconductive drum 10. A support bearing (a second support bearing) 501 is provided in the developing unit supporting tray 500. The developing unit supporting tray 500 is configured to be capable of pivoting about a supporting shaft (not shown in the figure) inserted into the support bearing 501.

The rod member 300 is a bar-like member disposed in parallel to the major axis direction of the line-type LED exposing unit 11. The rod member 300 is moved in the major axis direction to thereby cause the line-type LED exposing unit 11 to separate from and approach the photoconductive drum 10 in the radial direction of the photoconductive drum 10 via the exposing unit supporting tray 400 and, at the same time, rotate the developing unit 13 about the developing unit supporting section 131 via the developing unit supporting tray 500 to cause the magnet roller 12 to separate from and approach the photoconductive drum 10. More specific action of the separation and approach unit 200 is explained below.

Figure 5:
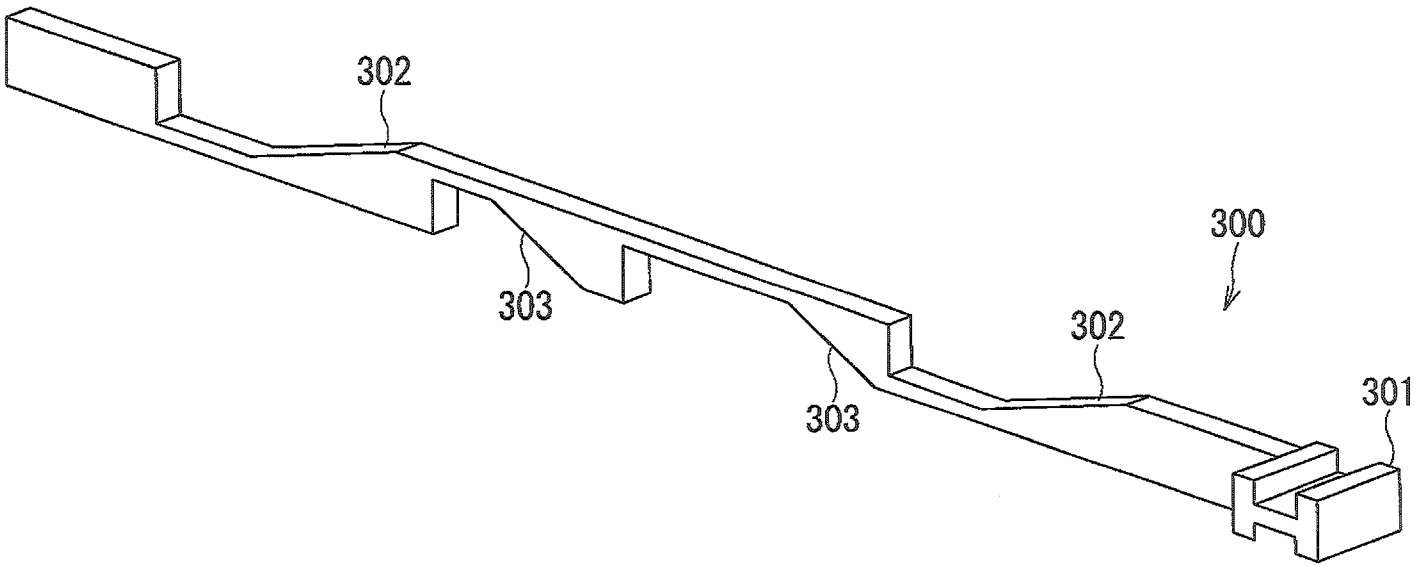
FIG. 5 is an external perspective view showing an example of the structure and the shape of a rod member.

FIG. 5 is an external perspective view showing an example of the structure and the shape of the rod member 300 of the separation and approach unit 200. A handle 301 for a user to push and pull the rod member 300 is provided at one end (an end on the front side) in the major axis direction of the rod member 300. Here, the front side is defined as a side where the user accesses the image forming apparatus 100 for operation, maintenance, and the like among four sides around the image forming apparatus 100. The opposite side of the front side is a rear side.

Two slopes (first slopes) 302 are formed along the major axis direction on the upper surface of the rod member 300, i.e., a surface opposed to the line-type LED exposing unit 11. Steps are formed before and behind the slopes 302.

On the other hand, two slopes (second slopes) 303 are formed along the major axis direction on the lower surface of the rod member 300, i.e., a surface on the opposite side of the line-type LED exposing unit 11. Steps are formed before and behind the slopes 303 as well.

(3) Separation and Approach of the Line-Type LED Exposing Unit

Figure 6:
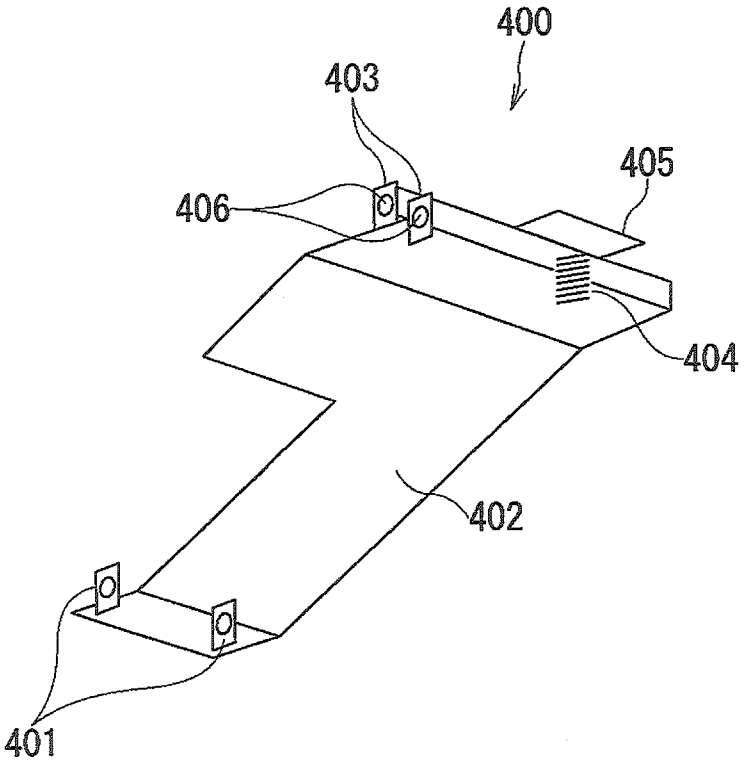
FIG. 6 is an external perspective view showing an example of the structure and the shape of an exposing unit supporting tray.

FIG. 6 is an external perspective view showing an example of the structure and the shape of the exposing unit supporting tray 400 of the separation and approach unit 200. The exposing unit supporting tray 400 is formed by a tabular member 402 and the like. The support bearings 401 are fixed on one side of the tabular member 402. Coupling members 403 and a compression spring 404 are provided on the other side. The side where the support bearings 401 are fixed is referred to as rear end side of the exposing unit supporting tray 400. The side where the coupling members 403 and the compression spring 404 are provided is referred to as front end side of the exposing unit supporting tray 400. An extending piece 405 extending from the tabular member 402 is further formed on the front end side of the exposing unit supporting tray 400.

The coupling members 403 couple the exposing unit supporting tray 400 and the line-type LED exposing unit 11. Specifically, a coupling protrusion 113 (see FIGS. 8A and 8C) provided on the lower surface of the line-type LED exposing unit 11 is engaged in engaging holes 406 of the coupling members 403, whereby the exposing unit supporting tray 400 and the line-type LED exposing unit 11 are coupled. The coupling holes 406 allow for small play.

If the line-type LED exposing unit 11 is caused to approach the photoconductive drum 10, the compression spring 404 presses the lower surface of the line-type LED exposing unit 11 with predetermined pressing pressure in the direction of the photoconductive drum 10 and absorbs the play of the engaging holes 406.

The extending piece 405 ascends and descends on the slopes 302 while being in contact with the upper surface of the rod member 300 according to the movement in the major axis direction of the rod member 300.

The action of the rod member 300 and the exposing unit support tray 400 configured as explained above is explained with reference to FIGS. 7A and 7B and FIGS. 8A to 8D.

Figure 7A:
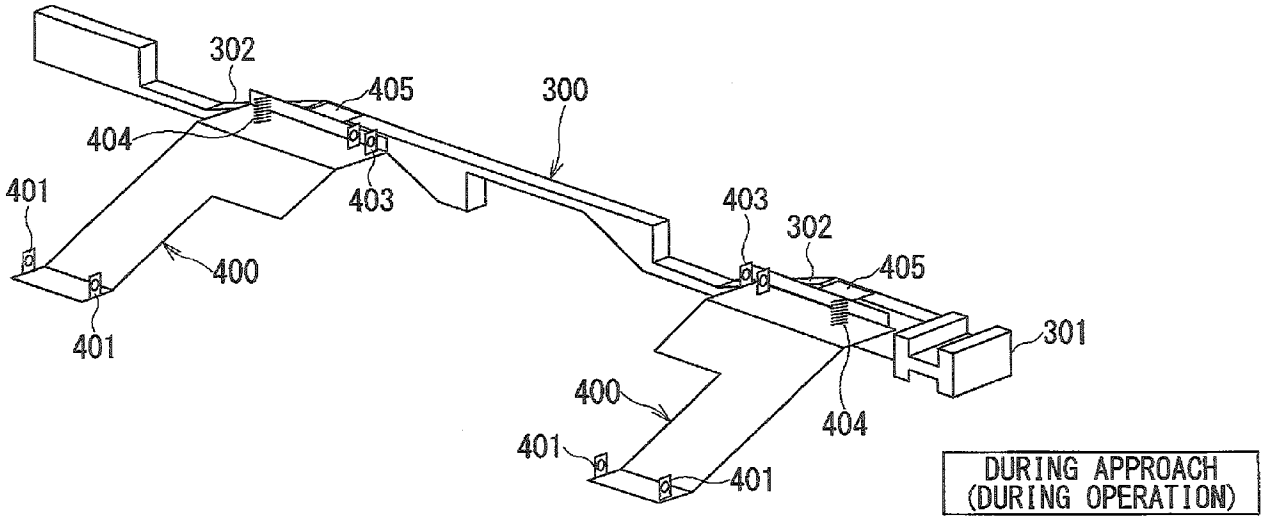
FIGS. 7A and 7B are perspective views respectively showing positional relations between the rod member and the exposing unit supporting tray during approach and during separation.
Figure 7B:
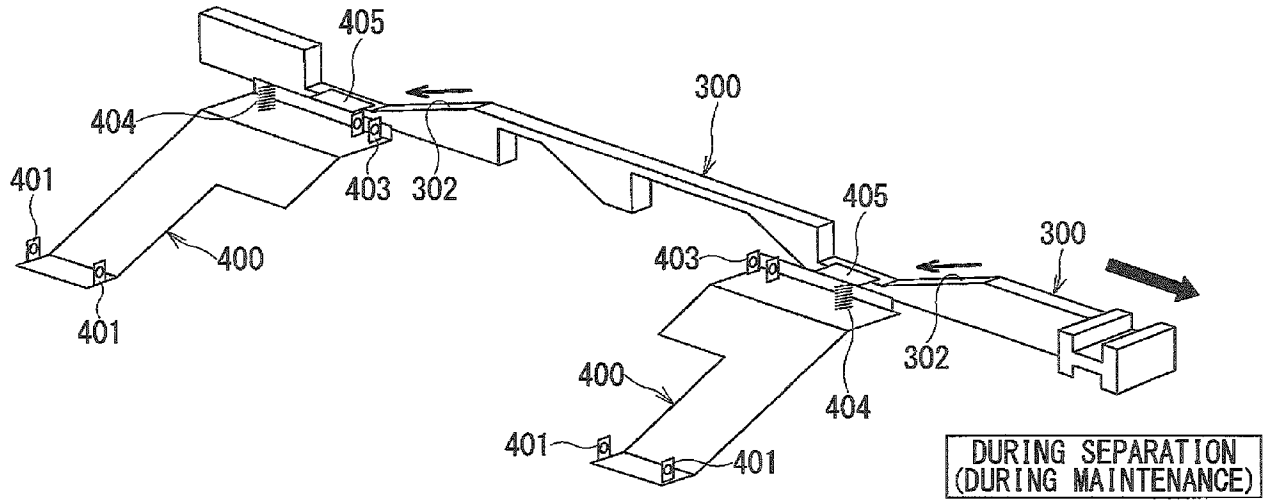
Figure 8B:
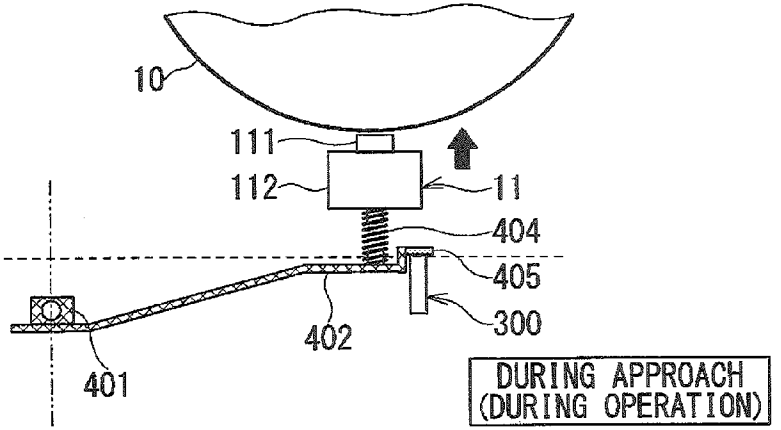
FIGS. 8A and 8B are respectively diagrams of the positional relation of the rod member and the exposing unit supporting tray during the approach viewed from different directions.
Figure 8D:
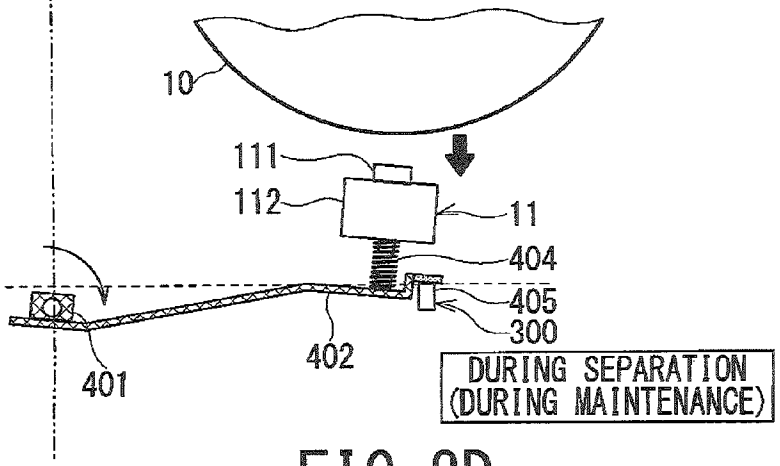
FIGS. 8C and 8D are respectively diagrams of the positional relation of the rod member and the exposing unit supporting tray during the separation viewed from different directions.
Figure 8A:
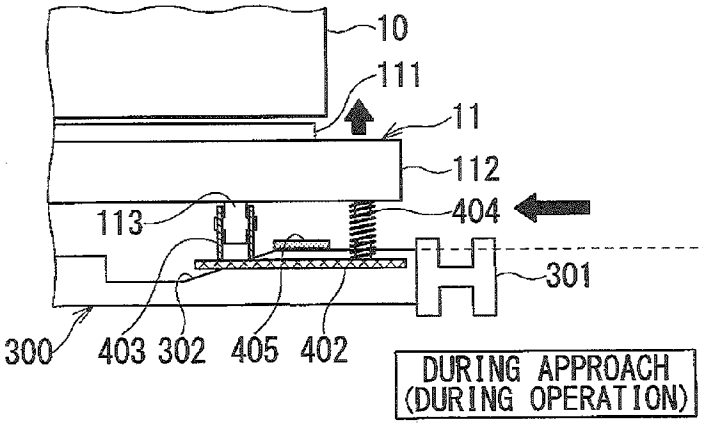
Figure 8C:
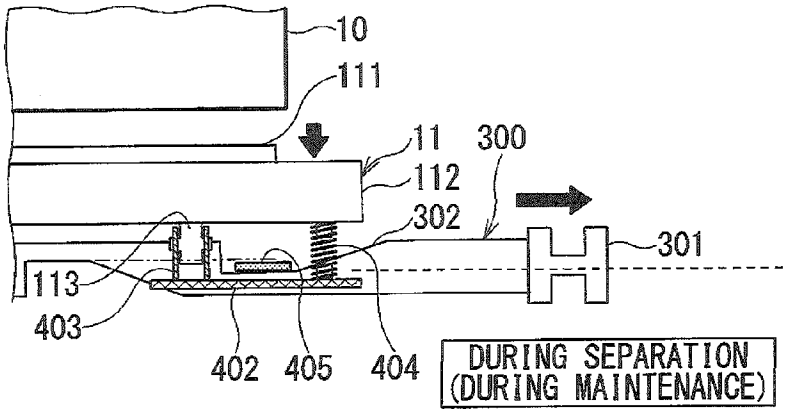

FIGS. 7A and 7B are perspective views showing positional relations between the rod member 300 and the exposing unit supporting tray 400. FIGS. 8A to 8D are diagrams showing positional relations between the line-type LED exposing unit 11 and the photoconductive drum 10 in addition to positional relations between the rod member 300 and the sections (the coupling members 403, the compression spring 404, and the extending piece 405) of the exposing unit supporting tray 400. Among the figures, FIGS. 8A and 8C are diagrams of the positional relations viewed from a direction orthogonal to the rotation axis of the photoconductive drum 10. FIGS. 8B and 8D are diagrams of the positional relations on the rear side viewed from the front side.

Among the figures, FIGS. 7A, 8A, and 8B are diagrams corresponding to a state in which the rod member 300 is pushed in from the front side to the rear side (during approach (during operation)). If the rod member 300 is pushed in, the extending piece 405 of the exposing unit supporting tray 400 ascends to the position of the high step present on the front side of the slope 302 of the rod member 300. The coupling members 403 and the compression spring 404 present on the front end side of the exposing unit supporting tray 400 also ascend in association with the ascending of the extending piece 405 (see FIGS. 8A and 8B). Note that, as explained above, the coupling protrusion 113 present on the lower surface of the line-type LED exposing unit 11 and the coupling members 403 are engaged. Therefore, if the coupling members 403 ascend, the line-type LED exposing unit 11 also ascends, i.e., the line-type LED exposing unit 11 moves in the radial direction of the photoconductive drum 10. The line-type LED exposing unit 11 approaches the photoconductive drum 10. The line-type LED exposing unit 11 is pressed against the spacer 110 (see FIG. 2) by the pressing force of the compression spring 404. The line-type LED exposing unit 11 stops in a state in which the line-type LED exposing unit 11 is close to the photoconductive drum 10.

On the other hand, FIGS. 7B, 8C, and 8D are diagrams corresponding to a state in which the rod member 300 is pulled out to the front side (during separation (during maintenance)). The own weight of the line-type LED exposing unit 11 is applied to the extending piece 405 in the downward direction via the coupling members 403. Therefore, if the rod member 300 is pulled out to the front side, the extending piece 405 of the exposing unit supporting tray 400 slips down on the slope 302 of the rod member 300 with the own weight of the line-type LED exposing unit 11 and descends to the position of the low step present on the rear side of the slope 302. The coupling members 403 and the compression spring 404 present on the front end side of the exposing unit supporting tray 400 also descend in association with the descending of the extending piece 405. The line-type LED exposing unit 11 descends together with these sections (see FIGS. 8C and 8D). As a result, the line-type LED exposing unit 11 separates from the photoconductive drum 10.

In the separation and approach unit 200 according to this embodiment, main force for causing the line-type LED exposing unit 11 to approach the photoconductive drum 10 is transmitted to the line-type LED exposing unit 11 via the coupling member 403 of the exposing unit supporting tray 400. The compression spring 404 of the exposing unit supporting tray 400 is a spring for absorbing the play of the coupling members 403 and pressing the line-type LED exposing unit 11 against the spacer 110. The compression spring 404 itself is not requested to have a large pressing force. Therefore, when the line-type LED exposing unit 11 is separated from the photoconductive drum 10, a small separation force is sufficient. Thus, components having high rigidity are not necessary in the separating mechanism.

In addition, as explained above, the configuration of the separation and approach unit 200 in this embodiment is extremely simple. When the line-type LED exposing unit 11 is caused to approach the photoconductive drum 10, one action of pushing in the rod member 300 using the handle 301 is sufficient. Similarly, when the line-type LED exposing unit 11 is separated from the photoconductive drum 10, one action of pulling out the rod member 300 using the handle 301 is sufficient. Therefore, the separation and contact unit 200 in this embodiment is not only simple in structure but also can realize extremely high operability.

(4) Separation and Approach of the Developing Unit

Figure 9:
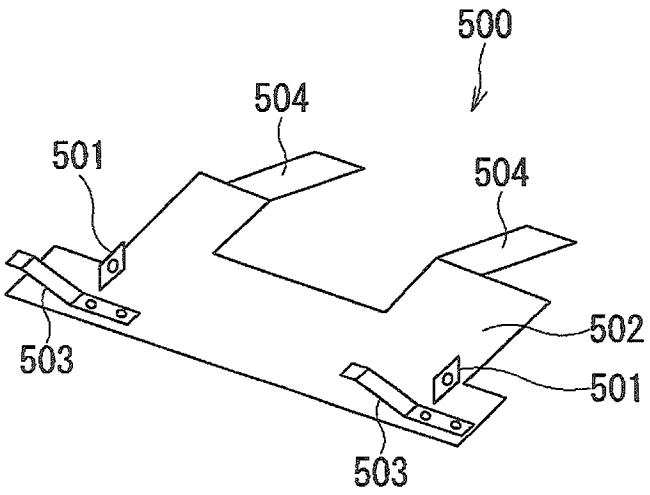
FIG. 9 is an external perspective view showing an example of the structure and the shape of a developing unit supporting tray.

FIG. 9 is an external perspective view showing an example of the structure and the shape of the developing unit supporting tray 500 of the separation and approach unit 200. The developing unit supporting tray 500 is formed by a tabular member 502 and the like. Unit supporting sections 503 that support a lower part of the developing unit 13 are provided on one side of the tabular member 502 (referred to as rear end side of the developing unit supporting tray 500). The unit supporting sections 503 are configured by, for example, leaf springs. Contact pieces 504 that come into contact with the lower surface of the rod member 300 are provided on the other side of the tabular member 502 (referred to as front end side of the developing unit supporting tray 500). Support bearings (second support bearings) 501 are provided between the contact pieces 504 and the unit supporting sections 503. The developing unit supporting tray 500 is configured to be capable of pivoting about a supporting shaft (not shown in the figure) inserted into the support bearings 501.

The action of the developing unit supporting tray 500 and the rod member 300 configured as explained above is explained with reference to FIGS. 10A and 10B and FIGS. 11A to 11D.

Figure 10A:
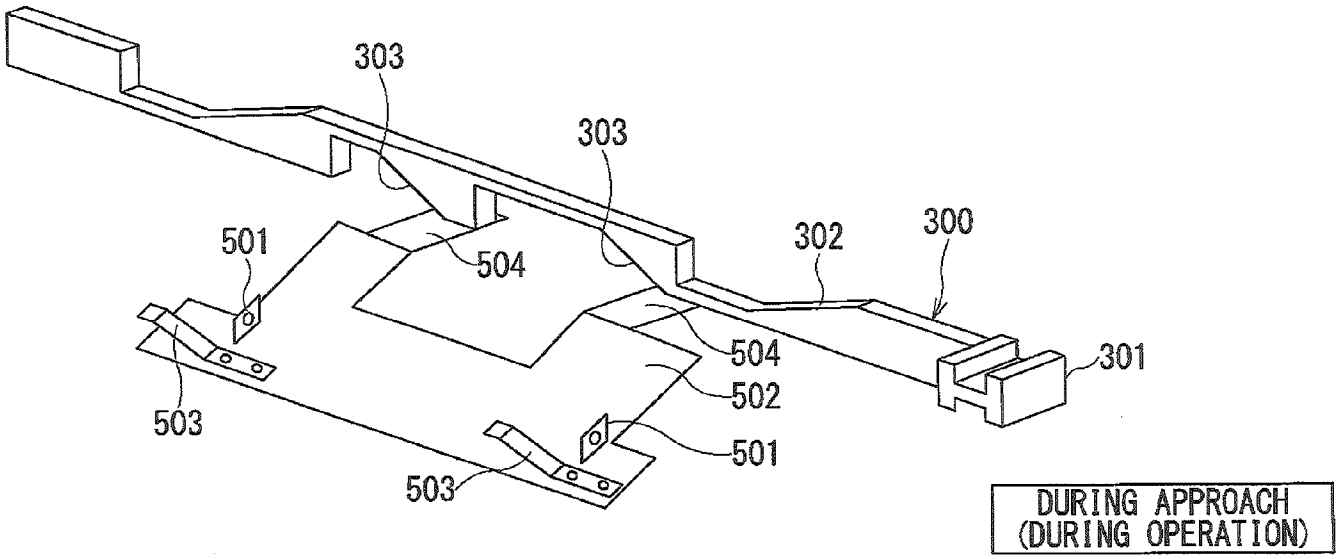
FIGS. 10A and 10B are perspective views respectively showing positional relations between the rod member and the developing unit supporting tray during approach and during separation.
Figure 10B:
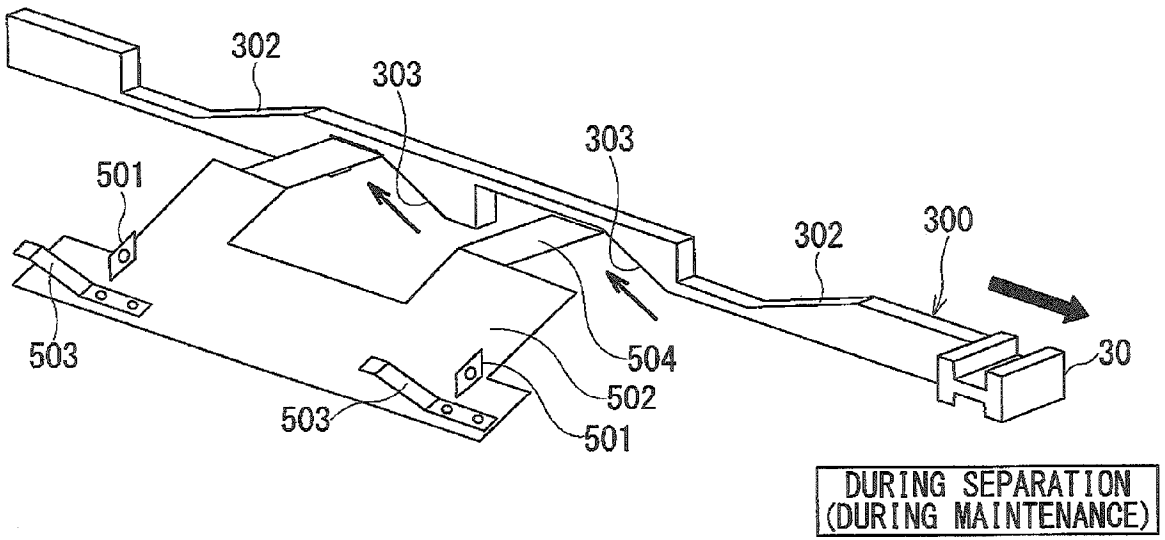
Figure 11B:
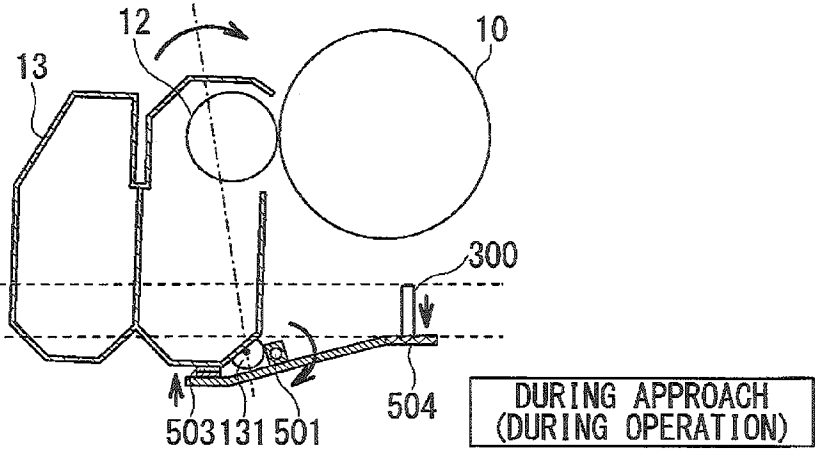
FIGS. 11A and 11B are respectively diagrams of a positional relation among the photoconductive drum, the developing unit, and the developing unit supporting tray during approach viewed from different directions.
Figure 11A:
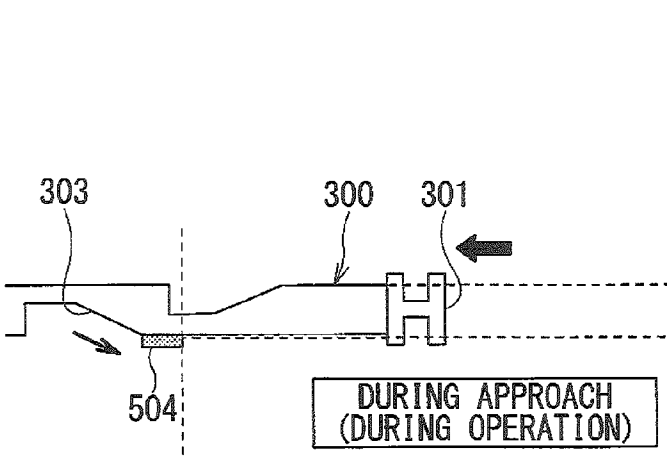
Figure 11D:
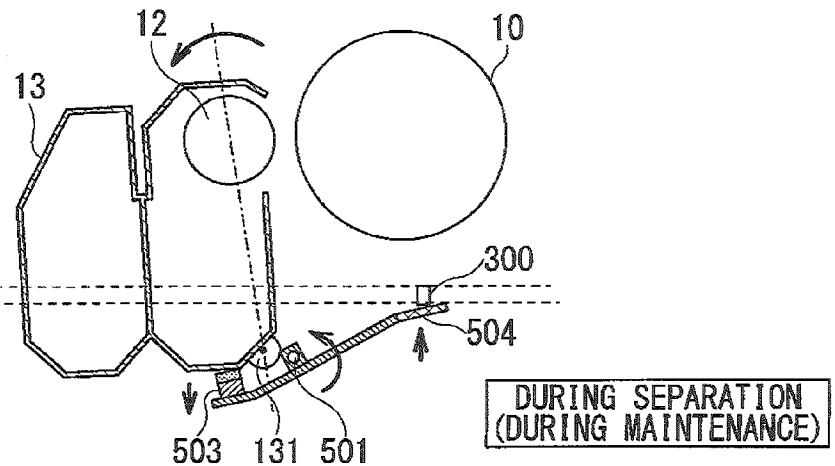
FIGS. 11C and 11D are respectively diagrams of a positional relation among the photoconductive drum, the developing unit, and the developing unit supporting tray during separation viewed from different directions.
Figure 11C:
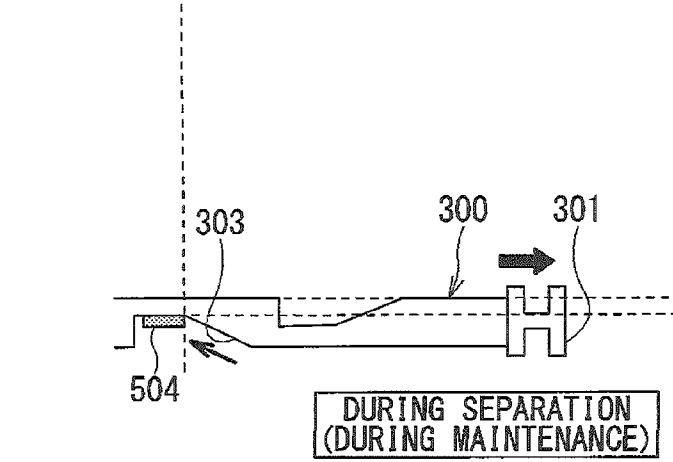

FIGS. 10A and 10B are perspective views showing positional relations between the rod member 300 and the developing unit supporting tray 500. FIGS. 11A to 11D are diagrams showing positional relations between the developing unit 13 and the photoconductive drum 10 in addition to positional relations between the rod member 300 and the sections (the support bearings 501, the unit supporting sections 503, and the contact pieces 504) of the developing unit supporting tray 500. Among the figures, FIGS. 11A and 11C are diagrams of the positional relations viewed from a direction orthogonal to the rotation axis of the photoconductive drum 10. FIGS. 11B and 11D are diagrams of the positional relations on the rear side viewed from the front side.

Among the figures, FIGS. 10A, 11A, and 11B are diagrams corresponding to a state in which the rod member 300 is pushed in from the front side to the rear side (during approach (during operation)). When the rod member 300 is pushed in, the contact pieces 504 of the developing unit supporting tray 500 descend to the position of the low step present on the front side of the slope 303 of the rod member 300. when the contact pieces 504 descend, the developing unit supporting tray 500 rotates about the supporting shaft inserted into the support bearings (the second support bearings) 501, while the unit supporting sections 503 present on the rear end side of the developing unit supporting tray 500 ascends.

According to the ascending of the unit supporting sections 503 (the leaf springs), the unit supporting sections 503 push up the bottom of the developing unit 13, the developing unit 13 rotates in the clockwise direction in FIG. 11B about the developing unit supporting section 131, and the magnet roller 12 of the developing unit 13 approaches the photoconductive drum 10 (see FIGS. 11A and 11B). A not-shown spacer is provided between the developing unit 13 and the photoconductive drum 10. The developing unit 13 is pressed against the spacer by the elastic force of the unit supporting sections 503 (the leaf springs). However, a predetermined gap defined by the spacer is secured between the magnet roller 12 and the photoconductive drum 10.

On the other hand, FIGS. 10B, 11C, and 11D are diagrams corresponding to a state in which the rod member 300 is pulled out to the front side (during separation (during maintenance)). The own weight of the developing unit 13 is applied to the unit supporting sections 503 of the developing unit supporting tray 500. The own weight acts in the upward direction on the contact pieces 504 present on the opposite side of the support bearings (the second support bearings) 501. Therefore, when the rod member 300 is pulled out to the front side, the contact pieces 504 slip up the slope 303 of the lower surface of the rod member 300, ascend to the position of the high step present on the rear side of the slope 303, and stop. Meanwhile, the developing unit 13 itself rotates, with the own weight thereof, in the counterclockwise direction in FIG. 11D about the developing unit supporting section 131 and stops at an angle corresponding to the stop position of the contact pieces 504. As a result, the magnet roller 12 of the developing unit 13 separates from the photoconductive drum 10.

As explained above, with the separating unit 200 in this embodiment, it is possible to separate the line-type LED exposing unit 11 from the photoconductive drum 10 with one action of pulling out the rod member 300 to the front side. At the same time, it is also possible to separate the magnet roller 12 of the developing unit 13 from the photoconductive drum 10.

Similarly, it is possible to cause the line-type LED exposing unit 11 to approach the photoconductive drum 10 with one action of pushing in the rod member 300 to the rear side. At the same time, it is also possible to cause the magnet roller 12 of the developing unit 13 to approach the photoconductive drum 10.

(5) Another Embodiment

Figure 12:
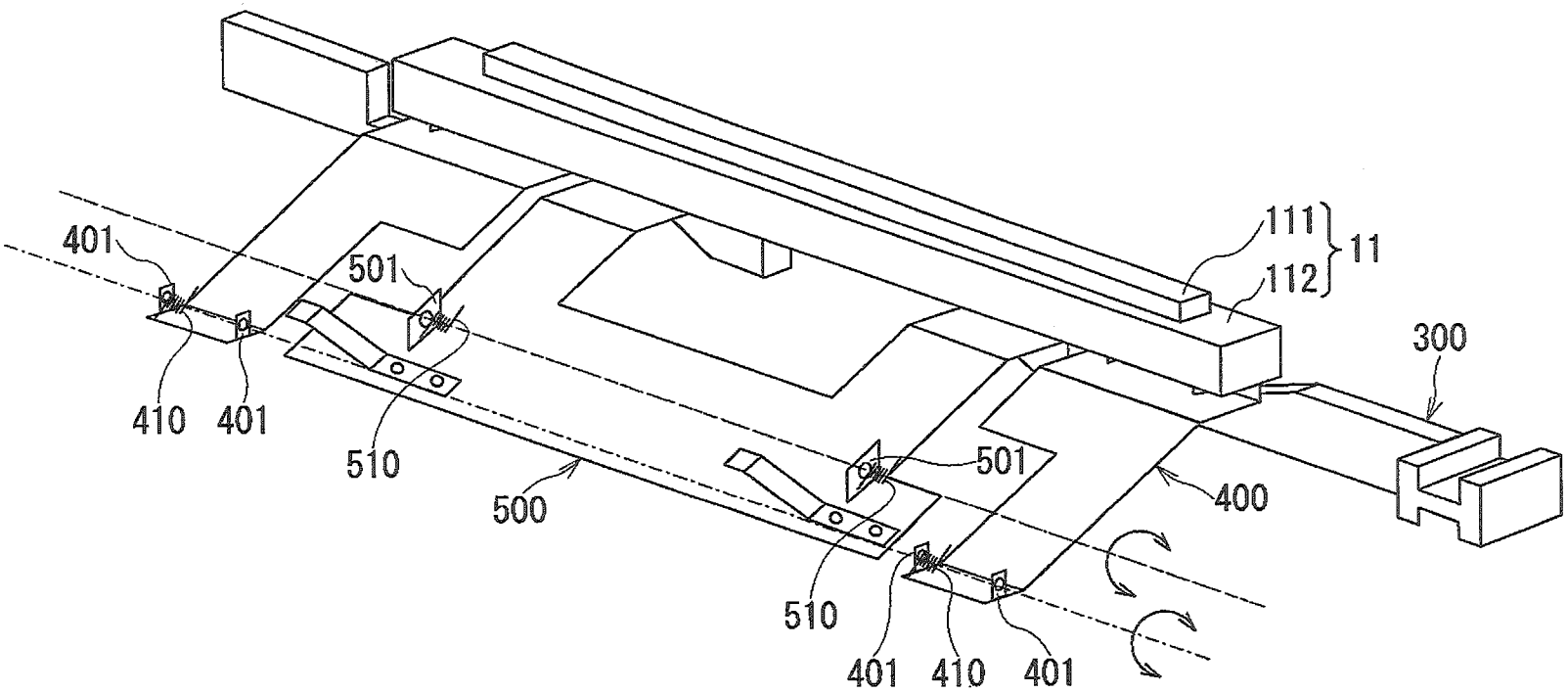
FIG. 12 is a diagram of an example of a separation and approach unit according to another embodiment.

FIG. 12 is a diagram showing an example of the separation and approach unit 200 in another embodiment. In the embodiment explained above, when the rod member 300 is pulled out to the front side, the extending piece 405 of the exposing unit supporting tray 400 slips down with the own weight of the line-type LED exposing unit 11 on the slope 302 on the upper surface of the rod member 300 and descends to the position of the low step present on the rear side of the slope 302.

The own weight of the developing unit 13 is applied to the unit supporting sections 503 of the developing unit supporting tray 500. The developing unit supporting tray 500 rotates about the support bearings (the second support bearings) 501 with the own weight. Further, the force by the own weight acts in the upward direction on the contact pieces 504 present on the opposite side of the support bearings (the second support bearings) 501.

In the other embodiment shown in FIG. 12, in order to supplement the force by the own weight of the line-type LED exposing unit 11, elastic members, for example, coil springs 410 that urge the extending piece 405 of the exposing unit supporting tray 400 in a direction away from the line-type LED exposing unit 11 are provided in the support bearings (the first support bearings) 401. It is possible to more smoothly perform, with the urging force of the coil springs 410, the descending of the extending piece 405 and the separating action of the line-type LED exposing unit 11 from the photoconductive drum 10.

Similarly, in the other embodiment shown in FIG. 12, in order to supplement the force by the own weight of the developing unit 13, elastic members, for example, coil springs 510 that urge the bottom of the developing unit 13 in a descending direction is provided in the support bearings (the second support bearings) 501. It is also possible to more smoothly perform the descending of the bottom of the developing unit 13 and the separating action of the developing unit 13 from the photoconductive drum 10.

As explained above, with the image forming apparatus 100 including the separation and approach unit 200 in the embodiments, it is possible to carry out, with simple operation, the separating action of the line-type LED exposing unit 11 and the developing unit 13 from the photoconductive drum 10 during maintenance or the like. Further, it is possible to configure, with components not required to have high rigidity and a small number of components, a separating mechanism for realizing the separating action.

While certain embodiments have been described, these embodiments have been presented by way of example only, and are not intended to limit the scope of the invention. Indeed, the novel apparatuses and units described herein may be embodied in a variety of other forms; furthermore, various omissions, substitutions and changes in the form of the apparatuses and units described herein may be made without departing from the spirit of the invention. The accompanying claims and their equivalents are intended to cover such forms or modifications as would fall within the scope and spirit of the invention.

What is claimed is:

1. An image forming apparatus comprising:

a photoconductive drum;

a line-type LED exposing unit disposed in an opposing relation to the photoconductive drum;

an exposing unit supporting tray configured to support the LED exposing unit so as to be capable of separating from the photoconductive drum in a radial direction of the photoconductive drum, an extending piece being formed in a part of an end of the exposing unit supporting tray;

a rod member disposed parallel to a major axis direction of the LED exposing unit and movable in the major axis direction to thereby cause the LED exposing unit to separate from the photoconductive drum in the radial direction of the photoconductive drum via the extending piece of the exposing unit supporting tray;

a developing unit including a magnetic roller; and a developing unit supporting tray configured to support the developing unit to enable the magnetic roller to separate from the photoconductive drum, wherein a first slope extending along the major axis direction is further formed on a lower surface of the rod member, a unit supporting section configured to support the developing unit is provided at one end of the developing unit supporting tray, and a contact piece configured to come into contact with the lower surface of the rod member is provided at the other end of the developing unit supporting tray.

2. The apparatus according to claim 1, wherein a second slope extending along the major axis direction is formed on an upper surface of the rod member present on the LED exposing unit side, and the rod member is moved in the major axis direction to thereby move the extending piece in the radial direction of the photoconductive drum along the second slope and cause the LED exposing unit to approach and separate from the photoconductive drum in the radial direction of the photoconductive drum via the extending piece.

3. The apparatus according to claim 2, wherein a handle for pushing in and pulling out the rod member is provided at one end in the major axis direction of the rod member, when the rod member is pushed in using the handle, the LED exposing unit approaches the photoconductive drum in the radial direction, and when the rod member is pulled out using the handle, the LED exposing unit separates from the photoconductive drum in the radial direction.

4. The apparatus according to claim 3, wherein a coupling member that couples a lower surface of the LED exposing unit and the exposing unit supporting tray is provided in the exposing unit supporting tray.

5. The apparatus according to claim 4, wherein a compression spring is provided between the lower surface of the LED exposing unit and the exposing unit supporting tray.

6. The apparatus according to claim 1, wherein a support bearing configured to rotatably support the exposing unit supporting tray is provided at an end on an opposite side of the extending piece of the exposing unit supporting tray, and an elastic member configured to urge the extending piece of the exposing unit supporting tray in a direction away from the LED exposing unit is provided around the first support bearing.

7. The apparatus according to claim 1, wherein a support bearing configured to rotatably support the developing unit supporting tray is provided between the unit supporting section and the contact piece in the developing unit supporting tray, and the rod member is moved in the major axis direction, whereby the contact piece moves in the radial direction of the photoconductive drum along the first slope to rotate the developing unit supporting tray about the support bearing, the unit supporting section causes a bottom of the developing unit to ascend and descend according to the rotation, and the magnetic roller in the developing unit is caused to approach and separate from the photoconductive drum according to the ascending and descending of the bottom.

8. The apparatus according to claim 7, wherein a handle for pushing in and pulling out the rod member is provided at one end in the major axis direction of the rod member, when the rod member is pushed in using the handle, the LED exposing unit approaches the photoconductive drum in the radial direction and the magnetic roller in the developing unit also approaches the photoconductive drum, and when the rod member is pulled out using the handle, the LED exposing unit separates from the photoconductive drum in the radial direction and the magnetic roller in the developing unit also separates from the photoconductive drum.

9. The apparatus according to claim 7, wherein an elastic member configured to urge the bottom of the developing unit in a descending direction is provided around the support bearing.

* * * * *